United States Patent [19]

Lectard et al.

[11] 4,277,289

[45] Jul. 7, 1981

[54] PROCESS FOR REMOVING TITANIFEROUS AND SILICO-ALUMINOUS INCRUSTATIONS FROM SURFACES

[75] Inventors: Alain Lectard, Aix-en-Provence; Robert Magrone, Gardanne, both of France

[73] Assignee: Aluminum Pechiney, Lyons, France

[21] Appl. No.: 55,685

[22] Filed: Jul. 6, 1979

[30] Foreign Application Priority Data

Jul. 19, 1978 [FR] France ..... 78 22523
May 23, 1979 [FR] France ..... 79 13925

[51] Int. Cl.[3] ..... B08B 3/08

[52] U.S. Cl. ..... 134/3; 134/10; 134/22 R; 134/28; 134/30; 134/41

[58] Field of Search ..... 134/3, 10, 22 R, 28, 134/30, 41; 252/79.3, 142, 146

[56] References Cited

U.S. PATENT DOCUMENTS

| | | | |
|---|---|---|---|
| 2,711,364 | 6/1955 | Beach | 134/3 X |
| 3,010,854 | 11/1961 | Satterfield | 252/79.3 X |
| 3,514,407 | 5/1970 | Missel | 252/79.3 |
| 3,562,013 | 2/1971 | Mickelson et al. | 134/3 |
| 3,725,224 | 4/1973 | Kendall | 134/3 X |
| 3,753,776 | 8/1973 | Winkhaus et al. | 134/3 |
| 3,891,456 | 6/1975 | Hohman et al. | 134/3 |

FOREIGN PATENT DOCUMENTS

| | | | |
|---|---|---|---|
| 1949778 | 4/1971 | Fed. Rep. of Germany | 134/3 |
| 7014247 | 4/1971 | Netherlands | 134/3 |

*Primary Examiner*—Marc L. Caroff
*Attorney, Agent, or Firm*—McDougall, Hersh & Scott

[57] ABSTRACT

A process for cleaning the walls of heat exchangers or reactors which are covered with essentially titaniferous incrustations but which can also contain silico-aluminous incrustations formed during the attack of ores and causing a considerable reduction in the heat exchange capacity, the said process being intended to restore the fundamental characteristics of the said walls, which is characterized in that the incrustations are removed by means of an aqueous treatment liquor containing from 3 to 30% by weight of hexafluosilicic acid and at most 10% by weight of hydrofluoric acid. The aqueous treatment liquor can contain a corrosion inhibitor and the treatment can be carried out at a temperature between 20° C. and 80° C.

8 Claims, No Drawings

PROCESS FOR REMOVING TITANIFEROUS AND SILICO-ALUMINOUS INCRUSTATIONS FROM SURFACES

The present invention relates to a new process for cleaning heat exchangers, the walls of which are covered with incrustations, more particularly incrustations of titaniferous origin which are deposited during the attack of ores and which cause a reduction in their heat exchange capacity.

For some time now, the skilled man has encountered numerous, often insurmountable, difficulties in maintaining the essential characteristics of heat exchangers located in reactors, owing to the frequent appearance of a parasitic phase on the walls of these exchangers. This is why, in the very field of the attack of ores, incrustations which can be very refractory are formed on the heat exchange surfaces during the attacking reaction, causing the useful cross-section of the reactor, but particularly the heat exchange coefficient of the exchanger itself to vary.

As these incrustations can cause a harmful development in the fundamental characteristics of heat exchangers and attacking reactors, cleaning solutions which are fairly successful have been proposed to the skilled man in an attempt to remove them.

Among the most advanced conventional solutions which are known and have been described in the specialist literature for overcoming this phenomenon, one type of cleaning process involved removing the incrustation from the walls to be treated mechanically by vigorous scraping, by the action of impacts, vibrations, brushing, sand-blasting, etc., or again by the combined action of these methods.

Another type of cleaning process involved carrying out a chemical treatment on the reactor walls by solubilizing or decomposing the incrustations. Thus, for example, a process has been proposed, for cleaning walls which are incrusted with incrustations formed at an attacking temperature higher than 180° C., which involves circulating an acidic liquor composed of hydrochloric acid and hydrofluoric acid at a relatively high temperature in the apparatus to be treated.

Although a process of this type is a substantial improvement over the known methods, it seems that it cannot be applied universally to all types of reactor. In fact, experiments have shown that the mere chemical action of the acidic couple was insufficient to remove the incrustations completely. It has consequently been found to be necessary to combine a mechanical action by the injection of water under high pressure with the chemical action of this couple. Thus, the process seems to be a combination of a chemical method and a mechanical method which is applied in accordance with the piston discharge principle and which is consequently only applicable to tubular reactors.

Since the problem of cleaning the walls has only been solved inadequately as the processes proposed had the major disadvantages just described, the applicants have pursued their research in this field and have found and developed a greatly improved cleaning process which provides an effective solution to the problems encountered by the skilled man.

The process for cleaning, according to the invention, the walls of heat exchangers or of reactors which are covered with incrustations which are essentially titaniferous but which can also contain silico-aluminous materials formed during the attack of ores, and which reduce considerably the heat exchange capacity, a process intended to restore the fundamental characteristics of the said walls, is characterised by the fact the incrustations are removed by means of an aqueous liquor of hexafluosilicic acid and hydrofluoric acid, this mixture comprising from 3% to 30% by weight of hexafluosilicic acid and at most 10% by weight of hydrofluoric acid.

After a certain period of operation, as already mentioned, the heat transfer surfaces of the ore attacking installations become the seat for essentially titaniferous, solid and compacted incrustations which form during the attacks.

To try and remove this scale which is particularly undesirable, the applicants have attempted to dissolve it by means of an aqueous solution of particularly active acids at reasonable concentrations and attacking temperatures.

Thus, they firstly made use of an aqueous liquor of hydrofluoric acid. However, they have observed by way of illustration that no more than 5% of the scale could be dissolved at a reasonable attacking temperature, such as 60° C., for a 4% by weight HF composition.

Similarly, when using an aqueous liquor of hexafluosilicic acid ($H_2SiF_6$), they have observed, for example, that no more than 30% of the scale could be dissolved with a 13% by weight $H_2SiF_6$ liquor and for an identical attacking temperature.

The applicants then observed with interest that an aqueous liquor containing a mixture of at most 10% by weight of hydrofluoric acid and from 3 to 30% by weight of hexafluosilicic acid had the synergetic power of removing from 80 to 100% of the scale treated in this way when the treatment temperature is between 20° C. and 80° C.

The applicants have been able to demonstrate that the hexafluosilicic acid was the active agent in dissolving the scale as it passivated the attacked surface of the scale during its action by depositing silica, and that the hydrofluoric acid reactivated the dissolution reaction by regenerating the hexafluosilicic acid.

It is preferred to make use of an aqueous liquor which contains from 5 to 15% of hexafluosilic acid and from 1 to 4% of hydrofluoric acid.

According to a variation of the process which allows the time needed for the descaling of industrial installations to be reduced, it is possible to use an aqueous liquor of hexafluosilicic acid alone as liquor for dissolving the incrustations and to add to it continuously or at frequent intervals, as the incrustations dissolve, the quantities of hydrofluoric acid needed to regenerate only the hexafluosilicic acid in such a way that the concentration of free hydrofluoric acid in the liquor for dissolving the incrustations is as low as possible and preferably zero.

In this case, the hydrofluoric acid added to the aqueous dissolution liquor containing the hexafluosilicic acid can be added in a very concentrated form which can attain 40% by weight of HF in aqueous solution.

In practice, it has turned out to be desirable to introduce the hydrofluoric acid in the form of a concentrated aqueous solution allowing the hexafluosilicic acid to be regenerated without causing a considerable increase in the volume of dissolution liquor in the industrial installation during the descaling operation.

As the incrustations are dissolved regularly, the aqueous liquor containing the hydrofluoric acid is introduced into the industrial installation during the cleaning operation at a flow-rate which is monitored by any apparatus of a known type which is suitable for this use, such as, for example, a metering pump.

The flow rate at which the aqueous hydrofluoric acid liquor is introduced is controlled in such a way that the concentration of hexafluosilicic acid in the dissolution liquor remains relatively constant and virtually equal to the starting concentration.

Thus, the concentration of $SiF_6$=ions remains constant throughout the entire operation of dissolving the scale while only the hydrofluoric acid is consumed and continuously regenerates the hexafluosilicic acid. Thus, it has been possible to carry out several scale dissolving operations with the same cleaning liquor, each time utilizing the liquor originating from a previous cleaning operation, the composition of which had been adjusted by adding hydrofluoric acid.

The Examples below demonstrate broadly the synergetics action of the HF and $H_2SiF_6$ couple in aqueous liquor when it is used to dissolve the scale.

Example 1 demonstrates the action of the hydrofluoric acid alone.

Example 2 illustrates the action of the hexafluosilicic acid alone.

Example 3 shows the synergetic action of the HF and $H_2SiF_6$ couple.

Example 4 confirms the synergetic action of the couple at other concentrations.

Example 5 illustrates the influence of the temperature on the kinetics of dissolving scale.

Example 6 concerns the cleaning of a badly scaled industrial installation using an aqueous liquor containing the HF and $H_2SiF_6$ couple.

Example 7 is the same.

Example 8 concerns the cleaning of a badly scaled industrial installation with an aqueous dissolution liquor containing hexafluosilicic acid to which is continuously added an aqueous hydrofluoric acid liquor which ensures that the hexafluosilicic acid is regenerated continuously.

EXAMPLE 1

50 kg of a scale originating from the mechanical cleaning of an industrial installation was attacked in an industrial pilot plant. The scale had the following composition expressed in % by weight:

$TiO_2$: 42.0%
CaO: 22.8%
$Fe_2O_3$: 9.0%
$Al_2O_3$: 12.8%
$SiO_2$: 1.7%
$Na_2O$: 3.9%
$H_2O$ combined + miscellaneous: 7.8%

The averate thickness of the scale was 4 mm.

1.5 $m^3$ of hydrofluoric acid liquor in a concentration of 4% by weight was then introduced.

The temperature was raised to 60° C. for a period of 7 hours, the medium being stirred continuously.

At the end of this period, 1.16 kg of $TiO_2$ were passed into a solution corresponding to an attack yield of 5.5%, leaving the layer of scale virtually unattacked.

EXAMPLE 2

50 kg of scale having the same origin as the one mentioned in Example 1 was attacked using the same pilot plant and adopting the same conditions of time and temperature with an aqueous solution of hexafluosilicic acid having a concentration of 13.1% by weight and a volume of 1.5 $m^3$.

At the end of the attacking time, 6.3 kg of $TiO_2$ were passed into a solution corresponding to a yield of 30%.

The appearance of the scale had changed. It exhibited a white surface deposit which, after analysis, turned out to be a deposit of silica.

EXAMPLE 3

50 kg of scale having the same origin as the one mentioned in Example 1 was attacked using the same pilot plant and adopting the same conditions of time and temperature, with 1.5 $m^3$ of an aqueous liquor containing 1.94% by weight of HF and 6.52% by weight of $H_2SiF_6$.

At the end of the attacking time, 17.0 kg of $TiO_2$ were passed into a solution corresponding to a yield of 81%.

The thickness of the residual scale after this attack was less than 1 millimeter on average.

Thus, the aqueous liquor composed of the mixture of HF and $H_2SiF_6$ is found to hold back a synergetic power in the dissolution of the scale when its action is compared to that of HF or $H_2SiF_6$ alone.

EXAMPLE 4

50 kg of scale having the same origin as the one mentioned in Example 1 was attacked using the same pilot plant and adopting the same conditions of time and temperature with 1.5 $m^3$ of an aqueous liquor containing 3.88% by weight of HF and 13.04% by weight of $H_2SiF_6$.

At the end of the attacking time, 20.5 kg of $TiO_2$ were dissolved, representing a yield of 97.5%.

The remaining scale had disintegrated completely and exhibited the appearance of a powder suspended in the liquor.

Thus, the increase in the HF and $H_2SiF_6$ concentration of the attacking liquor improves the yield of dissolution of scale to be removed.

EXAMPLE 5

After observing that the mixture of HF and $H_2SiF_6$ had a synergetic power on the dissolution of essentially titaniferous scales, the applicants have been led to study the influence of the temperature on the reaction kinetics.

In order to do this, 45 kg of a scale were attacked in an industrial pilot plant by an aqueous liquor containing a mixture of 1.94% of HF and 6.52% of $H_2SiF_6$, the percentages being expressed as percentages by weight.

The scale to be attacked had the following composition:

$TiO_2$: 28.1%
CaO: 16.1%
$Fe_2O_3$: 11.7%
$Al_2O_3$: 18.3%
$SiO_2$: 8.7%
$Na_2O$: 8.2%
$H_2O$ combined + miscellaneous: 8.9%

The volume of the attacking liquor was 1.4 $m^3$.

Three temperatures were studied: 25° C., 60° C., 80° C.

Samples were taken over a period in order to determine the yield of the reaction.

All the results have been compiled in the Table below and express the yield of the reaction by the quantity, as a percentage by weight, of dissolved $TiO_2$.

| Time in Hours | ATTACKING TEMPERATURE 25° C. | 60° C. | 80° C. |
|---|---|---|---|
| 0.5 | no sample taken | no sample taken | 67.2% |
| 1 | 6.2% | 48.0% | 80.2% |
| 2 | 11.6% | 60.0% | 91.1% |
| 3 | no sample taken | no sample taken | 93.1% |
| 4 | 26.9% | 73.1% | test stopped |
| 6 | no sample taken | 84.7% | |
| 7 | no sample taken | test stopped | |
| 8 | 51.6% | | |
| 24 | 77.2% | | |
| | test stopped | | |

This table therefore shows the increase in the reaction kinetics due to the rise in the temperature.

EXAMPLE 6

An industrial autoclave having a capacity of 42 $m^3$ and provided with a bank of heating tubes having a heating surface of 240 $m^2$ was cleaned.

The autoclave had a height of 10 m and a diameter of 2.5 m.

The bank of heating tubes made of A 42 steel was provided with 24 racks comprising eight tubes.

The mass of the scale deposited on the bank of heating tubes was estimated at 2 tonnes, its thickness varying from 5 mm to 10 mm.

Before the cleaning operation, the scale had the following composition:

| | Bottom of Bank | Top of Bank |
|---|---|---|
| Heat Loss | 3.3% | 5.7% |
| $SiO_2$ | 2.5% | 2.9% |
| $Al_2O_3$ | 5.4% | 6.2% |
| $Fe_2O_3$ | 15.7% | 16.7% |
| $P_2O_5$ | 1.3% | 1.4% |
| CaO | 27.5% | 24.7% |
| $TiO_2$ | 40.0% | 37.1% |
| $Na_2O$ | 3.6% | 3.6% |
| MgO | 0.7% | 1.7% |

42 $m^3$ of a treatment liquor having the following composition expressed as a percentage by weight were then introduced:

1.65% HF 7.8% $H_2SiF_6$ to which were added 3 kg/$m^3$ of liquor of a known type of passivator, lithsolvent 803 sold by Kebo.

The temperature was reached by circulating hot water in the bank of tubes up to the starting temperature of the reaction which took place by exothermicity.

The temperature was 40° C. at the beginning of the reaction and 48° C. at the end of the reaction.

The kinetics of the attack were followed by measuring the titanium present in the liquor during the cleaning treatment. The results are compiled in the following Table.

| Time in Hours | Development in g/l of the $TiO_2$ content present in the liquor during the attack |
|---|---|
| 0.5 | 0.2 |
| 1.5 | 0.5 |
| 5.0 | 2.1 |

-continued

| Time in Hours | Development in g/l of the $TiO_2$ content present in the liquor during the attack |
|---|---|
| 6.5 | 2.9 |
| 9.5 | 5.7 |
| 14.5 | 7.7 |
| 17.5 | 11.6 |
| 21.5 | 13.4 |
| 24.0 | 15.4 |

1.7 tonne of scale was virtually dissolved after 24 hours of treatment.

The wall of the reactor was very clean. A few fine films of scale which was still adhering which could not be evaluated quantitatively remained on the wall.

No obvious trace of corrosion was observed.

EXAMPLE 7

Some exchangers in a tubular installation having an internal diameter of 177.7 mm were cleaned.

In order to do this, the treatment liquor was prepared in a tank provided with a stirrer and had the following composition expressed as a percentage by weight:

2.14% HF 5.86% $H_2SiF_6$ to which were added 3 kg/$m^3$ of liquor of a known type of passivator, lithsolvent 803 sold by Kebo.

The treatment liquor was then pumped into the tubular installation to be cleaned, in which it circulated at a speed of 1.2 m/s while at the same time passing through the tank with stirring.

The treatment liquor was initially circulated in a fraction of the badly scaled tubular installation (average thickness 5 mm) representing a length of 45 m. The liquor was circulated in this fraction of the installation for 12 hours at a temperature of 45° C.

Then, at the end of this time, the treatment liquor was circulated over an assembly of 10 tubes in series, representing a length of 600 meters, the treatment temperature being raised to 61° C. by circulating hot water in the double envelope.

The operation was stopped after 5 hours.

Of the 10 tubes treated, 5 were cleaned completely while the other 5 were not cleaned perfectly.

8 additional tubes which had not yet been descaled were added in series to the 5 tubes which had not been cleaned completely. The 13 tubes combined in this way were traversed by the previous treatment liquor which had been readjusted by the addition of 880 kg of HF. The readjusted liquor was thus circulated for 8 hours, being maintained at a temperature of 55° C. throughout.

After these various operations, the exchangers of the tubular installation were clean.

The kinetics of the attack were followed during the entire operation by measuring the titanium present in the treatment liquor during the cleaning treatment.

The results are compiled in the Table below:

| Time in hours | Number of tubes to be cleaned | Development in g/l of $TiO_2$ content in the liquor during the operation |
|---|---|---|
| 7 | 1 | 1.0 |
| 12 | 1 | 2.0 |
| 13 | 10 | 4.4 |
| 14 | 10 | 5.7 |
| 15 | 10 | 6.5 |

-continued

| Time in hours | Number of tubes to be cleaned | Development in g/l of $TiO_2$ content in the liquor during the operation |
|---|---|---|
| 16 | 10 | 7.0 |
| 17 | 10 | 7.3 |
| 19 | 13 | 11.7 |
| 21 | 13 | 12.6 |
| 23 | 13 | 13.2 |
| 25 end of the operation | 13 | 13.6 |

EXAMPLE 8

Some exchangers in a tubular installation having an internal diameter of 177.7 mm were cleaned.

The industrial assembly to be cleaned was composed of 10 tubes in series representing a length of 660 meters.

In order to carry out this cleaning operation, about 45 $m^3$ of a 6.1% by weight aqueous liquor of hexafluosilicic acid to which was added a passivator of a known type lithsolvent 803 sold by Kebo in a proportion of 3 $kg/m^3$ of liquor were prepared in a tank with stirring.

The treatment liquor prepared in this way was pumped into a tubular installation to be cleaned in which it circulated in closed circuit at a speed of 1.2 m/s, again passing through the tank with stirring.

The treatment temperature was raised to 54° C. by circulating hot water in the double envelope.

15 minutes after the beginning of the cleaning operation, 500 liters per hour of an aqueous solution of hydrofluoric acid containing 25% of HF were firstly added continuously by means of a metering pump.

The operation was stopped after 4 hours and it was observed that the 10 tubes were perfectly cleaned.

The kinetics of the attack were followed throughout the operation by measuring the quantity of titanium present in the treatment liquor, samples being taken at precise moments during the cleaning operation.

The results of the analyses are compiled in Table I below:

TABLE I

| Time in hours | Development of the $TiO_2$ content in g/l in the liquor during the cleaning operation |
|---|---|
| 0.5 | 4.0 |
| 1.0 | 6.0 |
| 1.5 | 8.6 |
| 2.0 | 10.3 |
| 3.0 | 11.4 |
| 4.0 | 11.7 |

The cleaning appeared to be practically complete after 3 hours of treatment, the increase in the $TiO_2$ content being slight between the third and fourth hour.

As a comparison, a fresh cleaning test was carried out during another run on the same apparatus which exhibited virtually the same degree of scaling.

The method of cleaning the industrial installation was identical to the one carried out previously.

Only the treatment liquor was different and had the following composition prior to its introduction into the industrial installation, expressed as a percentage by weight:

hexafluosilicic acid: 6.1% hydrofluoric acid: 1.9%

The temperature was maintained at 55° C. throughout the entire treatment operation.

718 kg of pure hydrofluoric acid in the form of an aqueous liquor containing 27% of HF were added after 3 hours 45 minutes.

The cleaning operation was stopped after 7 hours 30 minutes and the tubes were found to be clean.

The kinetics of the attack were followed throughout the operation by measuring the quantity of titanium present in the treatment liquor, samples being taken at precise moments during the cleaning operation.

The results of the analyses are summed up in Table II below

TABLE II

| Time in Hours | Development of the $TiO_2$ content in g/l in the liquor during the cleaning operation |
|---|---|
| 1.0 | 5.8 |
| 2.0 | 7.0 |
| 3.0 | 7.8 |
| 3.75 | 7.8 |
| 4.25 | 8.8 |
| 5.25 | 10.0 |
| 6.75 | 11.0 |
| 7.50 | 11.3 |

It appears that cleaning was practically complete after 7 hours of treatment, the increase in the $TiO_2$ content being slight between the two last samples.

Therefore it appears that the use of an aqueous treatment liquor containing a mixture of hexafluosilicic acid and hydrofluoric acid prior to its introduction into the apparatus to be cleaned requires a much longer residence time than that needed to achieve the same result using an aqueous liquor containing only hexafluosilicic acid prior to its introduction into the apparatus to be cleaned.

consequently, comparison of the two tables clearly shows the improvement provided by the continuous addition of hydrofluoric acid.

The following are representative of known passivators or corrosion inhibitors which may be used in the practice of this invention.

Lithsolvent 803, sold by Kebo

Lithsolvent E.B, sold by Kebo

Paracidive S, sold by Rhone Povlenc

Parcolite 25A, sold by Parker

We claim:

1. In a process for removing titaniferous incrustations and silico-aluminous incrustations from the walls of heat exchangers and reactors on which such incrustations form during the treatment of ores, the improvement comprising contacting the incrustations with an aqueous liquor containing from 3 to 30% by weight of hexafluosilicic acid and hydrofluoric acid present in an amount within the range of 1–10% by weight.

2. A process as claimed in claim 1, in which the hydrofluoric acid is added to the aqueous liquor during the contacting of the incrustations.

3. A process as claimed in claim 1, in which the hexafluosilicic acid is present in the aqueous liquor in an amount within the range of 5 to 15% and the hydrofluoric acid is present in an amount within the range of 1 to 4%.

4. A process as claimed in claim 1 in which the aqueous liquor contains a corrosion inhibitor.

5. A process as claimed in claim 1 in which the incrustations are contacted with the aqueous liquor at a temperature between 20° C. and 80° C.

6. A process as claimed in claim 5 which includes the step of adding hydrofluoric acid to an aqueous liquor which has previously been used in contacting incrustations to regenerate the aqueous liquor for reuse.

7. A process as claimed in claim 2 in which the hydrofluoric acid is added substantially continuously to the aqueous liquor during the contacting step.

8. A process as claimed in claim 2 in which the hydrofluoric acid is added in increments to the aqueous liquor during the contacting step.

* * * * *